United States Patent [19]

Silver

[11] 4,244,075

[45] Jan. 13, 1981

[54] PAD HOLDER FOR A SCOURING DEVICE

[76] Inventor: Louis J. Silver, 3434 Baker St., San Francisco, Calif. 94123

[21] Appl. No.: 70,977

[22] Filed: Aug. 30, 1979

[51] Int. Cl.[3] ..... A47L 17/08; A46B 17/02; A46B 5/02

[52] U.S. Cl. ..... 15/145; 15/143 R; 15/209 D; D4/12

[58] Field of Search ..... 15/105, 106, 111, 112, 15/117, 118, 121, 143 R, 144 R, 145, 176, 209 R, 209 D; D4/10-12, 31, 32

[56] References Cited

U.S. PATENT DOCUMENTS

| | | | |
|---|---|---|---|
| 2,917,057 | 12/1959 | Busseuil | 15/143 R X |
| 3,051,975 | 9/1962 | Schwartz | 15/117 X |
| 3,060,478 | 10/1962 | Silver | 15/244 R X |

FOREIGN PATENT DOCUMENTS

| | | | |
|---|---|---|---|
| 979063 | 1/1965 | United Kingdom | 15/209 D |

*Primary Examiner*—Edward L. Roberts

*Attorney, Agent, or Firm*—Owen, Wickersham & Erickson

[57] ABSTRACT

A unitary molded plastic pad holder for a scouring device having a handle portion and a cupped bell portion. The bell is a spherical shell segment with a lower edge lying along a plane and a parallel flat portion with an opening for the pad-securing device. The handle has a channel defined by an upper wall, side walls, and an end wall. The handle joins the bell at one side and at about 45° to the plane. The channel extends into the bell and is crossed and closed by a reinforcing arcuate wall perpendicular to the plane. The upper wall is joined to the flat portion of the bell by a pair of reinforcing diverging struts. The handle is reinforced by: (1) a lengthwise rib midway between the side walls, depending from the upper wall and extending from the arcuate wall to a point short of the end wall, (2) three transverse ribs joined to the upper wall, side walls and lengthwise ribs and inclined at about 45° to the upper wall, and (3) a pair of diagonal crossing ribs between the junctures of the two transverse ribs nearest the bell portion with the side walls.

3 Claims, 5 Drawing Figures

PAD HOLDER FOR A SCOURING DEVICE

BACKGROUND OF THE INVENTION

This invention relates to an improved pad holder for a scouring device.

The invention may be considered as an improvement over the pad holder shown in the scouring device described and claimed in U.S. Pat. No. 3,060,478. That scouring device was made of molded plastic and had a bell or cup-like pad support member which was a spherical segment and to which was attached a handle. Preferably, the bell and handle were molded as an integral member. The handle basically comprised a channel member defined by an upper wall and two side walls and closed at its outer end by an end wall.

That scouring device has been very well accepted by the public, but there was a structural problem: the handle tended to break when a user exerted a very strong force on it in the attempt to scour some difficult part of the utensil being scoured.

One object of the present invention is to solve this problem by providing a handle which can withstand considerably more pressure than is likely to be used upon it and which is extremely unlikely to break from use.

SUMMARY OF THE INVENTION

The invention provides a pad holder for a scouring device. It comprises a unitary molded plastic member having a handle portion extending out at about 45° from a cupped bell portion to which a scouring pad is to be attached.

The bell portion comprises a spherical shell segment with a lower edge lying along a plane and a central and upper flat portion lying parallel to that plane and having an opening for receiving a pad-securing device. The lower surface of the spherical shell segment is concave and preferably has a plurality of downwardly extending pad-engaging projections. The upper surface of the spherical shell segment is convex.

The handle portion is generally channel shaped. It has an upper wall with depending side walls along its length defining a channel between them, with a depending end wall at its outer end, joining the side walls together and closing the channel there. At its inner end the handle joins an outer peripheral portion of the bell portion at about 45° to the aforementioned plane, by a channel portion extending into the spherical shell segment and crossed by a reinforcing depending arcuate wall perpendicular to that plane and joining the side walls together and closing the channel there. The upper wall is joined to the flat portion and the upper surface of the bell portion by a pair of reinforcing diverging ribs generally perpendicular to said upper wall and to said flat portion.

The handle has a narrow portion between its inner and outer ends where the side walls curve in toward each other and then out again. The handle is reinforced in its channel by three integrally molded portions:

(1) A depending lengthwise rib thicker than the side walls lies midway between the side walls and depends perpendicularly from the upper wall. This rib is nearly as high as the side walls, and extends from the arcuate wall to a point near and short of the end wall.

(2) A series of three transverse ribs, about the height of the lengthwise rib or somewhat higher and thicker than the side walls. These ribs are joined to the upper wall and the side walls, as well as to the lengthwise rib, and are generally perpendicular to the aforementioned plane.

(3) A pair of diagonally extending ribs about the height of the lengthwise rib, crossing each other. Each of these ribs extends from a juncture of the transverse rib nearest the bell portion with a side wall to a juncture of the next transverse rib with the opposite side wall.

As a result of this reinforcing structure, the handle portion is protected from breaking due to exertion of pressures placed thereon when scouring.

DESCRIPTION OF A PREFERRED EMBODIMENT

Figure 3:
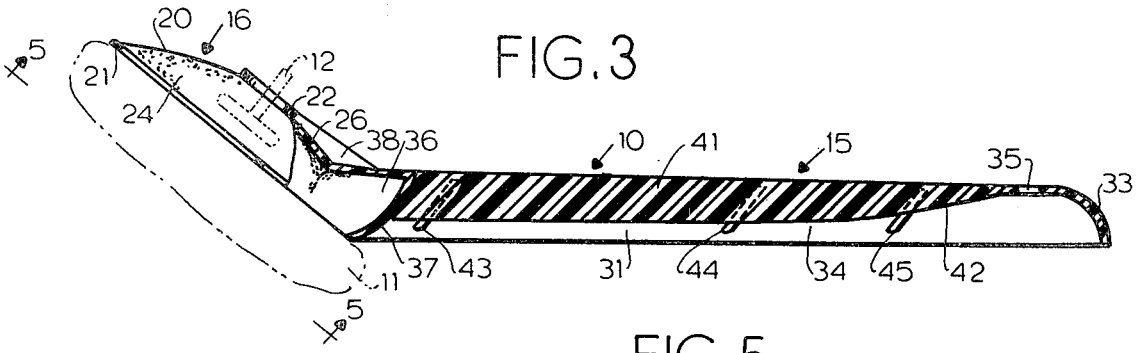
FIG. 3 is a view in section taken along the line of 3—3 in FIG. 2. In broken lines, a pad and a pad-securing device are shown attached to the pad holder.
Figure 4:
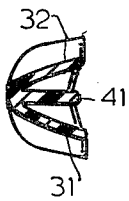
FIG. 4 is a view in section taken along the line 4—4 in FIG. 2.
Figure 5:
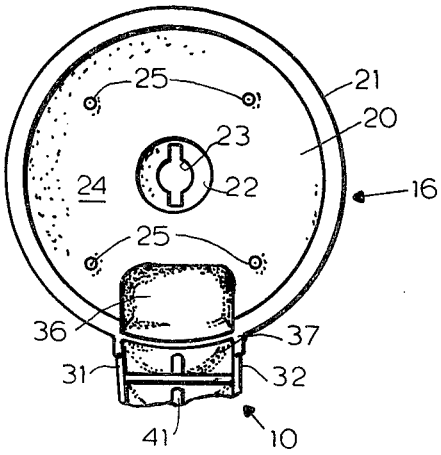
FIG. 5 is a view looking at FIG. 3 along the line 5—5.

The drawings show a pad holder 10 for a scouring device and FIG. 3 shows how a pad 11 may be secured to the pad holder by a secruing device 12. Basically, this is done in the same manner as that shown in U.S. Pat. No. 3,060,478.

The pad holder 10 comprises a unitary molded plastic member having a handle portion 15 extending out at about 45° from a cupped bell portion 16 to which the pad 11 is attached.

The bell portion 16 comprises a spherical shell segment 20 with a lower edge 21 lying along a plane P (See FIG. 3), and the bell portion 16 also has a central flat portion 22 which lies parallel to the plane P and has a suitably shaped opening 23 for receiving the pad-securing device 12. Preferably, the lower surface 24 of the spherical shell segment 20 is concave and has a plurality of downwardly extending pad-engaging projections 25. The upper surface 26 of this spherical shell segment is convex.

The handle portion 15 is generally channel shaped. It has an upper wall 30 with depending side walls 31 and 32 all along its length, with all three of the walls joined to the bell portion 16. There is a depending end wall 33 at the outer end of the handle joining the depending side walls 31 and 32 together enclosing the channel 34 there. Preferably near this there is a through opening 35 to enable hanging the handle on a hook. At its inner end, the handle 15 joins an outer peripheral portion of the bell 16 at about 45° to the plane P, doing this in a channel portion 36 extending into the spherical shell segment 20. This channel portion 35 is crossed by a (or separated from the channel 34 by) a reinforcing depending arcuate wall 37, which is perpendicular to the plane P and joins the side walls 31 and 32 together as well as the upper wall 30. This wall 37 closes the channel 34. The upper wall 30 is joined to the flat portion 22 and to the upper surface 26 of the bell 16 by a pair of reinforcing diverging ribs 38 and 39 that are generally perpendicular to the upper wall 30 and to the flat portion 22.

Figure 1:
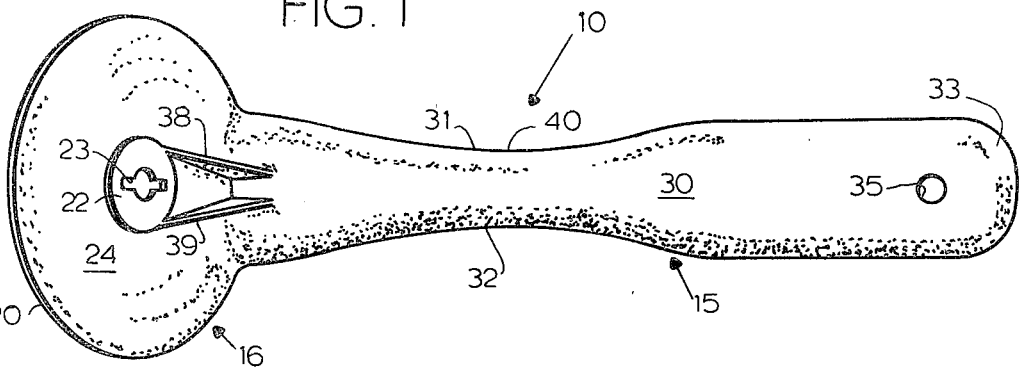
FIG. 1 is a top plan view of a pad-holding member embodying the principles of the invention.
Figure 2:
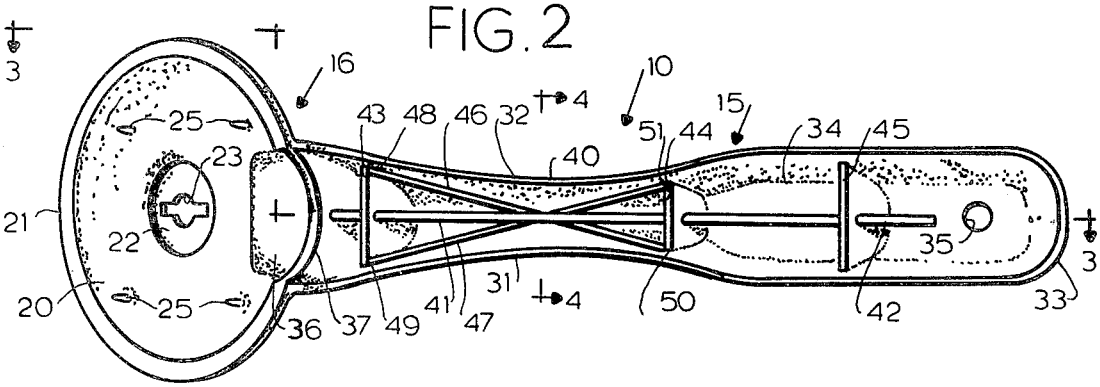
FIG. 2 is a bottom view thereof.

The handle 15 has a narrow portion or neck 40 in between its inner and outer ends. At this neck the side walls 31 and 32 curve in toward each other and then out again, as shown in FIGS. 1 and 2.

The handle 15 is reinforced in its channel 34 by integrally molded portions of which there are three types:

The first is a depending lengthwise rib 41 which is preferably thicker than either of the side walls 31 and 32 and also is thicker than the upper wall 30. It extends down from the upper wall 30 nearly, but not quite, as far as the side walls 31 and 32. At one end, this rib 41 joins the arcuate wall 37 and extends out toward the outer end but terminates short of the through opening 35 and short of the end wall 37. Its outer portion 42 gradually slopes down into the upper wall 30 as shown in FIG. 3.

The second type of reinforcing comprises a series of three transverse ribs 43, 44 and 45, each of which is about the thickness of the lengthwise rib 41 and therefore thicker than the side walls 31 and 32 and the upper wall 30. These ribs 43, 44, 45 are joined to the upper wall 30 and the side walls 31 and 32 and are integral with them. They are generally perpendicular to the plane P, lying at about 45° to the upper wall 30 and sloping outwardly toward the bell 16. Preferably, these ribs 43, 44, and 45 are a little shorter than the side walls 31 and 32 but extend slightly above the longitudinal rib 41.

The third type of reinforcing comprises a pair of diagonally extending ribs 46 and 47. These are about the height of the lengthwise rib 41 and cross that rib and each other. They are related to the two transverse ribs 43 and 44 that are nearest to the bell 16. Each rib 46 and 47 extends from a corner 48 or 49 where the transverse rib 43 joins one side wall 31 or 32 to a corner 50 or 51 where the transverse rib 44 joins the opposite side wall 32 or 31.

The strength provided by the especially shaped and especially located ribs 41, 43, 44, 45, 46, and 47 enables the handle 15 to withstand considerable force even against the neck 40, both in directions where the scouring pad 11 is being forced down against a utensil while the handle 15 is, in effect, being forced up, tending to break the device in two at the neck 40, and to sidewise pressures exerted when the scouring pad 11 is used against the side wall of a utensil. The combination of the diagonal ribs 46 and 47 and the transverse ribs 43, 44 and 45 with the lengthwise rib 41 gives reinforcement in several directions and results in making the handle 15 many times stronger than it was before.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A pad holder for a scouring device, comprising a unitary molded plastic member having a handle portion and a cupped bell portion to which a pad is to be attached, said bell portion comrpising a spherical shell segment with a lower edge lying along a plane and a central flat portion parallel to said plane and having an opening for receiving a pad-securing device, said handle portion being generally channel shaped and having an upper wall with depending side walls along its length defining a channel between them with a depending end wall at its outer end, joining the depending side walls together and closing said channel there, said handle joining said bell at one side thereof and at about 45° to said plane in a channel portion extending into said spherical segment and crossed by a reinforcing depending arcuate wall prependicular to said plane, joining said side walls together and closing the channel there, said upper wall being joined to the flat portion of said bell portion by a pair of reinforcing diverging ribs generally perpendicular to said upper wall, said handle being reinforced in said channel by integrally molded portions comprising, a depending lengthwise rib midway between said side walls, depending from said upper wall and extending from said arcuate wall to a point near and short of said end wall, a series of three transverse ribs joined to said upper wall and said side walls and inclined at about 45° to said upper wall in a direction toward said bell portion, and a pair of diagonally extending crossing ribs extending from the juncture of said transverse rib nearest said bell portion with said side walls to the juncture of the next said transverse rib with said side walls, whereby said handle portion is protected from breaking due to exertion of scouring pressures thereon while scouring.

2. A pad holder for a scouring device, comprising a unitary molded plastic member having a handle portion and a cupped bell portion to which a pad is to be attached, said bell portion comprising a spherical shell segment with a lower edge lying along a plane and a central flat portion parallel to said plane and having an opening for receiving a pad-securing device, the lower surface of said spherical shell segment being concave and having a plurality of downwardly extending pad-engaging projections, said handle portion being generally channel shaped and having an upper wall with depending side walls along its length defining a channel between them with a depending end wall at is outer end, joining the depending side walls together and closing said channel there, said handle joining said bell at one side thereof and at about 45° to said plane in a channel portion extending into said spherical segment and crossed by a reinforcing depending arcuate wall perpendicular to said plane, joining said side walls together and closing the channel there, said upper wall being joined to the flat portion of said bell portion by a pair of reinforcing diverging ribs generally perpendicular to said upper wall, said handle being reinforced in said channel by integrally molded portions comprising, a depending lengthwise rib midway between said side walls, depending from said upper wall and extending from said arcuate wall to a point near and short of said end wall, a series of three transverse ribs joined to said upper wall and said side walls and inclined at about 45° to said upper wall in a direction toward said bell portion, and a pair of diagonally extending crossing ribs extending from the juncture of said transverse rib nearest said bell portion with side walls to the juncture of the next said transverse rib with said side walls, whereby said handle portion is protected from breaking due to exertion of scouring pressures thereon while scouring.

3. A pad holder for a scouring device, comprising a unitary molded plastic member having a handle portion extending out at about 45° from a cupped bell portion to which a pad is to be attached, said bell portion comprising a spherical shell segment with a lower edge lying along a plane and a central flat portion lying parallel to said plane and having an opening for receiving a pad-securing device, the lower surface of said spherical shell segment being concave and having a plurality of downwardly extending pad-engaging projections, the upper surface of said spherical shell segment being convex, said handle portion being generally channel shaped and having an upper wall with depending side walls along its length defining a channel between them with a depending end wall at its outer end, joining the depending side walls together and closing said channel there, said handle at its inner end joining an outer peripheral portion of said bell portion at about 45° to said plane, in a channel portion extending into said spherical shell segment and crossed by a reinforcing depending arcuate wall perpendicular to said plane and joining said side walls together and closing the channel there, said upper wall being joined to the flat portion and the upper surface of said bell portion by a pair of reinforcing diverging ribs generally perpendicular to said upper wall and to said flat portion, said handle having a narrow neck portion between its inner and outer ends where said side walls curve in toward each other and then out again, said handle being reinforced in said channel by integrally molded portions comprising, a depending lengthwise rib thicker than said side walls midway between said side walls, depending perpendicularly from said side upper wall and nearly as high as said side walls, and extending from said arcuate wall to a point near and short of said end wall, a series of three transverse ribs, about the height of said lengthwise rib and thicker than said side walls, joined to said upper wall and said walls and generally perpendicular to said plane, and a pair of diagonally extending ribs about the height of said lengthwise rib, crossing each other and each extending from a juncture of said transverse rib nearest said bell portion with a said side wall to a juncture of the next said transverse rib with the opposite said side wall, whereby said handle portion is protected from breaking due to exertion of pressures placed thereon when scouring.

* * * * *

UNITED STATES PATENT AND TRADEMARK OFFICE

CERTIFICATE OF CORRECTION

PATENT NO. : 4,244,075

DATED : January 13, 1981

INVENTOR(S) : Louis J. Silver

It is certified that error appears in the above-identified patent and that said Letters Patent are hereby corrected as shown below:

Column 2, line 29, "secruing" should read --securing--.

Column 3, line 60, "comrpising" should read --comprising--.

Column 4, line 67, after "portion with" insert --said--.

Column 6, line 11, before "upper wall" delete "side".

Column 6, line 17, between "said" and "walls" insert --side--.

Signed and Sealed this

*Seventh* Day of *April 1981*

[SEAL]

*Attest:*

RENE D. TEGTMEYER

*Attesting Officer*

*Acting Commissioner of Patents and Trademarks*